US005337133A

United States Patent [19]

Siegel et al.

[11] Patent Number: 5,337,133

[45] Date of Patent: Aug. 9, 1994

[54] SYSTEM TO EXTEND FUSER ROLL LIFE

[75] Inventors: Robert P. Siegel, Penfield; Michael A. Malachowski; Paul A. Garsin, both of Webster; Rabin Moser, Victor, all of N.Y.

[73] Assignee: Xerox Corporation, Stamford, Conn.

[21] Appl. No.: 94,417

[22] Filed: Jul. 19, 1993

[51] Int. Cl.[5] ..... G03G 15/20

[52] U.S. Cl. ..... 355/285; 219/216; 355/321; 432/60

[58] Field of Search ..... 355/210, 218, 282, 284, 355/285, 290, 309, 321; 432/60; 219/216

[56] References Cited

U.S. PATENT DOCUMENTS

| | | | |
|---|---|---|---|
| 3,856,461 | 12/1974 | Jordan | 432/60 |
| 4,378,152 | 3/1983 | Edwards et al. | 355/285 |
| 4,572,648 | 2/1986 | Toriumi et al. | 355/290 |
| 5,241,348 | 8/1993 | Garavuso et al. | 355/282 |

OTHER PUBLICATIONS

Gustafson et al, "Roller Fuser," Research Disclosure, 19713, Sep. 1980, p. 364.

*Primary Examiner*—A. T. Grimley
*Assistant Examiner*—William J. Royer

[57] ABSTRACT

A system to extend fuser roll life in which image data is varied in its placement on the photoreceptive member and correspondingly, the image receiving substrate position is varied so as to maintain proper location of the image data on the substrate while varying the transverse position of the substrate transverse to the paper path direction. This position varying may take place sheet to sheet or in a job by job arrangement on a printing machine. This varying of lateral position of the sheet causes the high pressure, excessive wear area on the fuser roll to be distributed over a wider area on the roll and not concentrated at a single point at each edge of the sheet. This leads to longer fuser roll life and additionally provides the added benefit of preventing an oil buildup which degrades copies when larger legal size sheets are utilized and/or also preventing associated jams due to the oil buildup at the sheet edge.

12 Claims, 3 Drawing Sheets

SYSTEM TO EXTEND FUSER ROLL LIFE

Figure 1A:
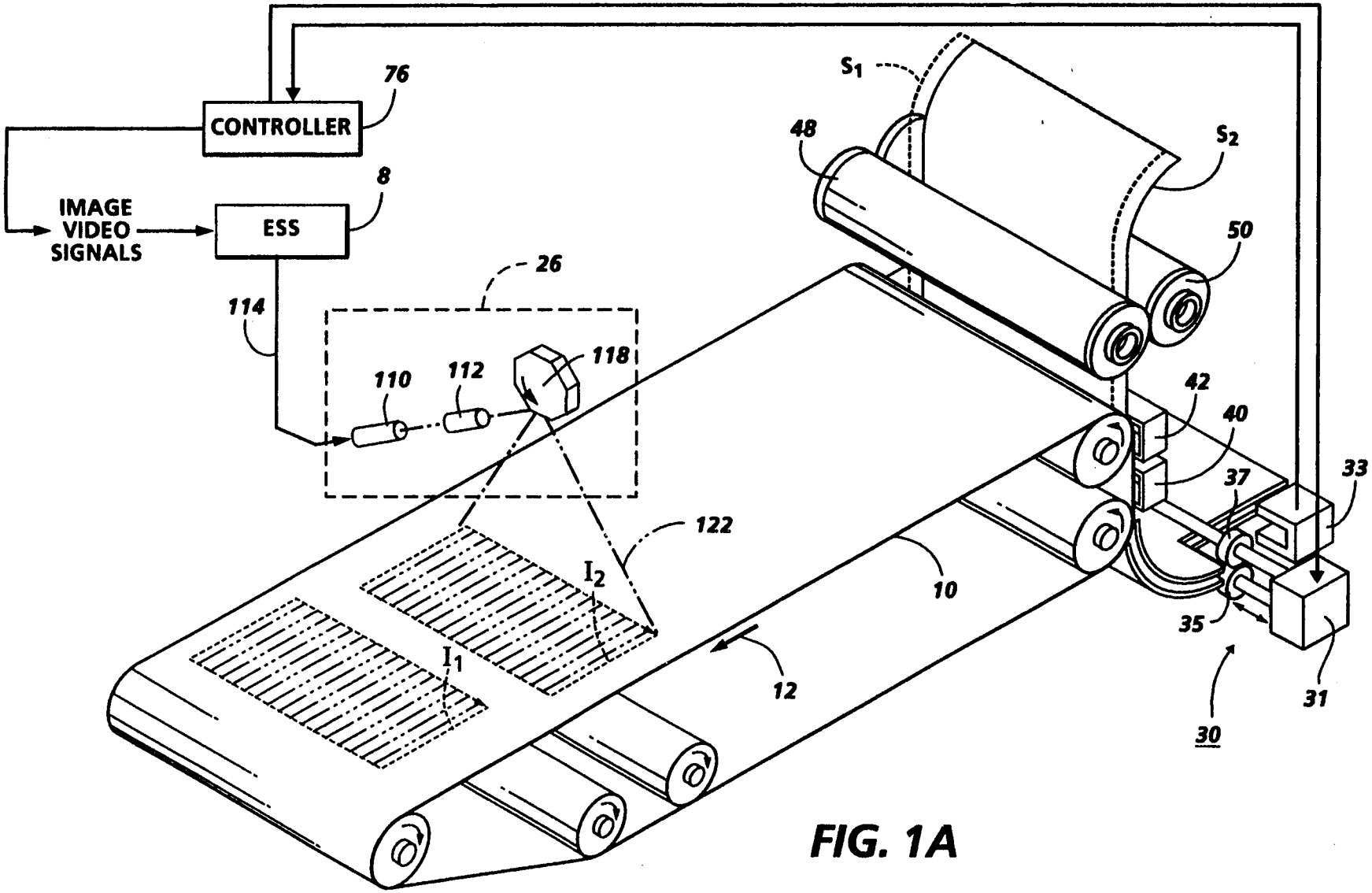

This invention relates generally to a system to extend fuser roll life, and more particularly concerns a device to move the registration position for a sheet and correspondingly moving the image data on a photoreceptor so that the sheet position is varied as it passes through a fuser assembly to minimize fuser roll wear at the sheet edge.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fuse the image formed by the toner onto the paper, electrophotographic printers incorporate a device commonly called a fuser. While the fuser may take many forms, heat or combination heat-pressure fusers are currently most common. One combination heat-pressure fuser includes a heat fusing roll in physical contact with a hard pressure roll. These rolls cooperate to form a fusing nip through which the copy sheet (the sheet on which the document is finally formed) passes.

Fuser rolls are typically in the form of a rotating cylinder, with an outer surface comprising a thin elastomeric layer which contacts the copy material. The outer surface may include a release material, such as silicone oil, to prevent toner from adhering to the surface of the fuser roll itself. Fuser rolls commonly used have outer layers of a thickness on the order of 0.002–0.07 inches (2 to 70 mils), while typical pressures exerted on the outer layer of a fuser roll are on the order of 50 to 150 psi.

It has been found that over an extended operating period, the copy material itself can cause excessive wear on certain portions of the fuser roll surface, most notably along the line where the relatively sharp edges of the copy material contact the fuser roll. The pressures associated with the fusing process create a stress line on the elastomeric layer along the edges of a sheet of copy material passing through the nip. When such stresses are repeated over thousands of sheets, a concentrated area of intense wear will result at each of the two points on the fuser roll corresponding to the edges of the sheets passing through. This problem is perhaps furthered by the tendency in the industry toward common sheet sizes, such as 11 inches. It is common among electrophotographic printers to feed 11-inch wide sheets through 14-inch wide rolls, because many designs preserve the option of feeding legal size (8.5" by 14") sheets through the fusing station in a long-edge feed manner. These areas of concentrated wear will clearly have a detrimental effect on the overall durability of fuser roll. Additionally, the use of release agents such as silicone oil, to aid in removing the sheet from the fuser roll can result in the deposit of an oily film on sheets of paper due to oil buildup in the legal size paper path when numerous standard size (8.5"×11") copies are fused.

It is desirous to provide a method of feeding sheets of copy material through a nip formed by fuser rolls, which tends to reduce the wear on the fuser roll that is concentrated in discrete areas of the fuser roll.

It is also desirous to provide such a method which does not necessarily require the addition of extensive ancillary equipment to an electrophotographic printing apparatus.

The following disclosures may be relevant to various aspects of the present invention:

U.S. Pat. No. 3,856,461 Patentee: Jordan Issue Date: Dec. 24, 1974

U.S. Pat. No. 4,378,152 Patentee: Edwards, et ano. Issue Date: Mar. 29, 1983

U.S. Pat. No. 4,572,648 Patentee: Toriumi, et ano. Issue Date: Feb. 25, 1986

U.S. application Ser. No.: 07/797,667 Inventor: Garavuso, et ano. Filing Date: Nov. 25, 1991

The relevant portions of the foregoing disclosures may be briefly summarized as follows:

U.S. Pat. No. 3,856,461 to Jordan, commonly assigned to the assignee of the present application, discloses one proposed method for obviating the problems of wear on the fuser rolls. In this invention, one fuser roll is supported for limited axial displacement relative to the other roll. This axial movement of one fuser roll relative to the other serves to offset spot wear on the surface of the fuser rolls by spreading out the area along the axis of the fuser roll which comes in contact with an edge of a sheet of copy material passing through the nip. This invention, however, requires a relatively sophisticated movable roll bearing structure, which includes a bearing lock to retain the bearing structure and one of the fuser rolls in a selected axial position.

U.S. Pat. No. 4,378,152 describes a fusing system in which a sheet is introduced to the fusing nip in a manner such that the sheet's initial point of contact is only a point on the sheet's leading edge.

U.S. Pat. No. 4,572,648 describes a fusing system in which the fusing nip is angled with respect to the direction of paper travel so that one of the edges of the paper enters the fusing nip prior to the second edge entering the nip.

U.S. application Ser. No.: 07/797,667 describes a fusing system in which a sheet is skewed prior to entering the fuser roll nip so that the edge contact area is distributed over a wider area of the soft fuser roll.

In accordance with one aspect of the present invention, there is provided an apparatus for fixing images to a substrate moving along a path. The apparatus comprises a fuser roll and a pressure member in contact with the fuser roll to form a nip therebetween. Means for varying the position of the substrate in a direction transverse to the path so that successive substrates move through the nip in different positions are also provided.

Pursuant to another aspect of the present invention, there is provided an electrophotographic printing machine of the type having an image recorded on a photoconductive member moving in a process direction, a developer unit for developing the image, a transfer unit for transfering the developed image to a substrate moving along a path, and a fusing unit including a fuser roll in contact with a pressure member to form a nip therebetween through which the substrate with the developed image thereon passes during fixing of the developed image to the substrate. The improvement comprises means for varying the position of the image recorded on the photoconductive member in a direction transverse to the process direction and means, responsive to said varying means, for adjusting the position of the substrate in a direction transverse to the path so that the transfer unit transfers the developed image to a selected position on the substrate with successive substrates moving through the nip formed by the fuser roll and pressure member in different positions transverse to the path.

Pursuant still to another aspect of the present invention, there is provided a method of electrophotographic printing in which an image recorded on a photoconductive member moving in a process direction is developed and transfered to a substrate moving along a path, the substrate with the transfered image moves through a nip defined by a fuser roll and a pressure member fusing the image to the substrate. The method comprises the steps of varying the position of successive images recorded on the photoconductive member in a direction transverse to the process direction and adjusting the position of the substrate in a direction transverse to the path in response to the varying step to transfer the developed image from the photoconductive member to the substrate in a selected position with successive substrates moving through the nip in positions transverse to the path.

Figure 1B:
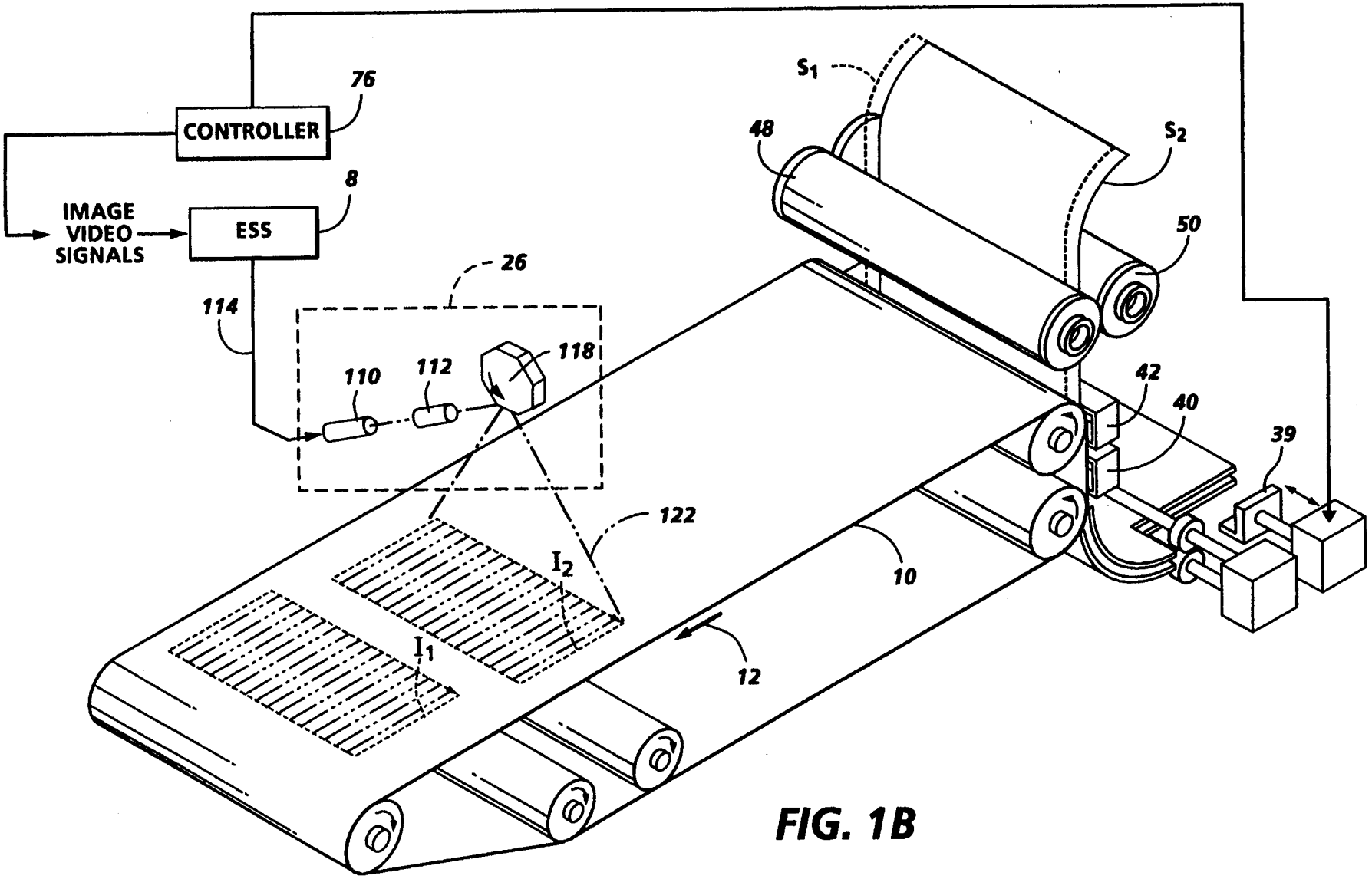

Other features of the present invention will become apparent as the following description proceeds and upon reference to the drawings, in which:

FIG. 1A is a perspective view of the principal components of the system to extend fuser roll life; FIG. 1B is a perspective view of the principal components of a second embodiment of the system to extend fuser roll life; and FIG. 2 is a schematic elevational view of an electrophotographic printing machine incorporating the FIG. 1 system therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 2 schematically depicts an electrophotographic printing machine incorporating the features of the present invention therein. It will become evident from the following discussion that the system to extend fuser roll life of the present invention may be employed in a wide variety of devices and is not specifically limited in its application to the particular embodiment depicted herein.

Figure 2:
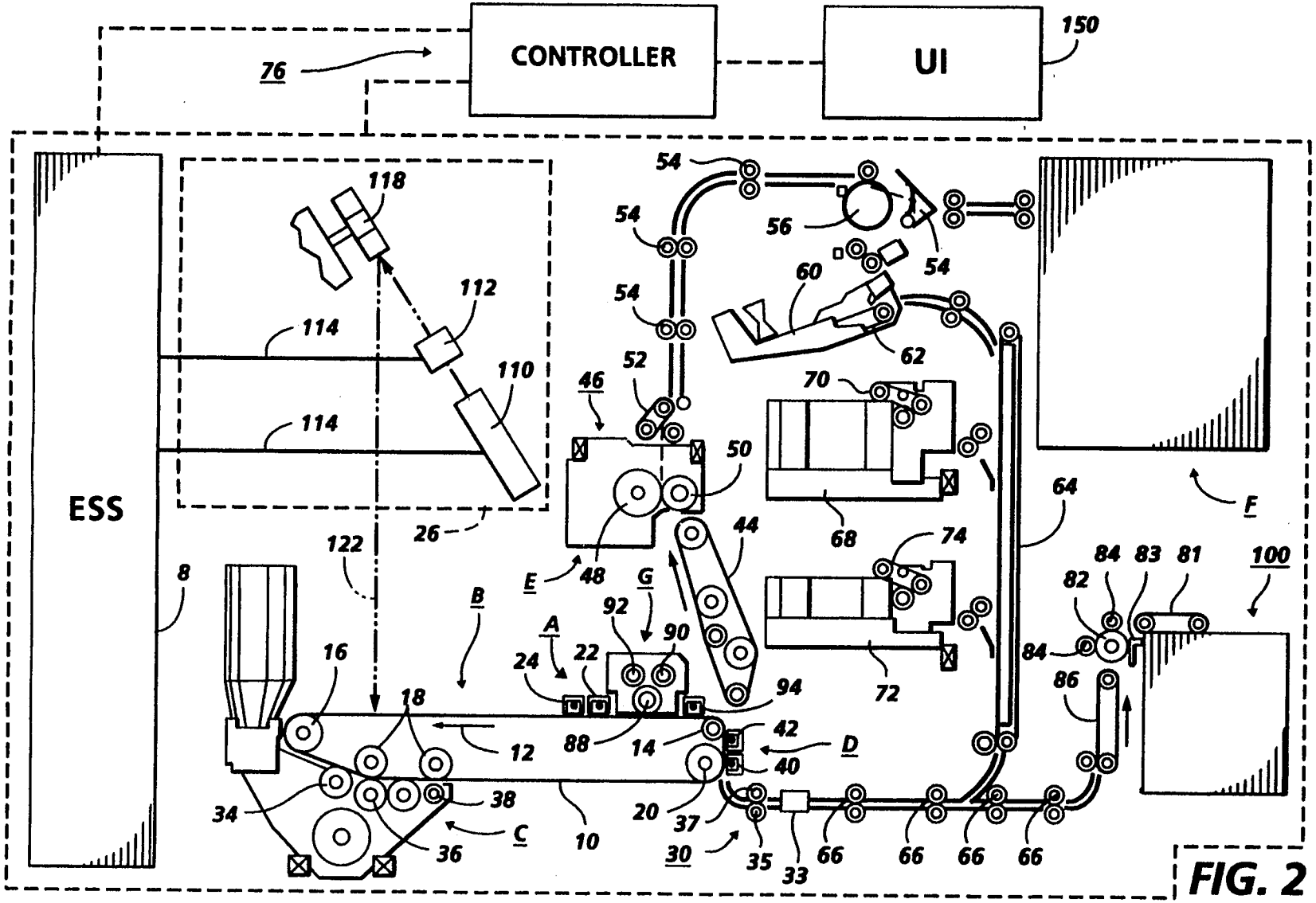

Referring to FIG. 2 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar TM. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler rollers 18 and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated generally by the reference numeral 26, records an electrostatic latent image on the photoconductive surface of the belt 10. Imaging module 26 includes a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Electrophotographic printing machines have increasingly utilized digital electronics technology to produce output copies from input video data representing original image information. In this case, it is known to use a raster output scanner (ROS) for exposing the charged portions of the photoconductive member to record the electrostatic latent image thereon. Generally, the ROS has a laser for generating a collimated beam of monochromatic radiation. The laser beam is modulated in conformance with the image information and is directed toward the surface of the photoconductive member through an optics system to form the desired image on the photoconductive member. In the optics system, the modulated laser beam is reflected through a lens onto a scanning element, typically a rotating polygon having mirrored facets such that the light beam is reflected from a facet and thereafter focused to a "spot" on the photoconductive member. The rotation of the polygon causes the spot to scan linearly across the photoconductive member in a fast scan (i.e., scan line) direction. Meanwhile, the photoconductive member is advanced in a process direction orthogonal to the scan line direction and relatively more slowly than the rate of the fast scan, the so-called slow scan direction. In this manner, the modulated laser beam is scanned across the recording medium in a raster scanning pattern. The light beam is intensity-modulated in accordance with an input image serial data stream at a rate such that individual picture elements ("pixels") of the image represented by the data stream are exposed on the photosensitive medium to form the latent image. As a result of the ability to precisely control the ROS, the image can be exposed on the photosensitive medium in a varying number of positions laterally with respect to the process direction.

Here, the imaging module 26 (ROS)includes a laser 110 for generating a collimated beam of monochromatic radiation 120, an electronic subsystem (ESS) 8, cooperating with the machine electronic printing controller 76 that transmits a set of signals via 114 corresponding to a series of pixels to the laser 110 and/or modulator 112, a modulator and beam shaping optics unit 112, which modulates the beam 120 in accordance with the image information received from the ESS 8, and a rotatable polygon 118 having mirror facets for sweep deflecting the beam 122 into raster scan lines which sequentially expose the surface of the belt 10 at imaging station B.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets are attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 face-down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

The copy sheet is registered just prior to entering transfer station D so that the sheet is aligned to receive the developed image thereon. In the preferred embodiment, the sheet is registered by way of a nonfixed edge registration device 30. A particularly effective device would be those such as described in copending U.S. patent application Ser. No. 07/891,106, now U.S. Pat. No. 5,219,159 commonly assigned to the assignee herein, the relevant portions of which are herein incorporated by reference. This registration device utilizes a translating set of drive nips together with a stepper motor to accurately locate and position a registration edge. As will be described further, the registration position can be varied laterally with such a device to achieve the objectives of the present invention. Alternatively, a registration device utilizing a laterally shiftable hard registration edge could also provide the necessary sheet offset.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity variable sheet size sheet feeder of the present invention, indicated generally by the reference numeral 100, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D. Further details of the operation of the system to extend fuser roll life will be described hereinafter with reference to FIG. 1.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 76. The controller 76 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected. Thus, when the operator selects the finishing mode, either an adhesive binding apparatus and/or a stapling apparatus will be energized and the gates will be oriented so as to advance either the simplex or duplex copy sheets to finishing station F.

Turning now to FIG. 1A, a perspective view of the principal components of the system to extend fuser roll life are illustrated. The photoreceptor belt 10 is shown with only the ESS, ROS 26, sheet registration device 30, transfer zone and fusing system, including the fuser roll 48 and backup roll 50, shown for clarification of the fuser roll life extension system. As can be seen, the ROS unit 26 receives a signal from the ESS and the rotating polygon causes a series of image data to be directed to the previously charged photoreceptive belt 10. As shown in FIG. 1A, $I_1$ represents a first portion of image data and $I_2$ represents a second portion of image data located in a laterally offset position from the image data of image $I_1$. This offset is accomplished by utilizing a slight timing differential with respect to the signals sent from the ESS to the ROS imager. Of course, an LED light bar imaging system could also be utilized and the image position transverse to the process direction can be varied across the width of the light bar so as to vary the image location on the photoreceptor.

As the imaged areas $I_1$ and $I_2$ are advanced further around the belt in the direction of arrow 12, the images will be developed as described above and ultimately transferred to the substrate, represented in FIG. 1A by $S_1$ and $S_2$. $S_1$ corresponds to the position of the sheet that would receive the image data $I_1$ and $S_2$ corresponds to the sheet that would receive the image data $I_2$. Of course it will be recognized that positions $I_1$ and $I_2$ are representative only and many other incremental positions could be used.

As a result of the image position being varied by the write source, the substrate position must be varied transverse to the paper path direction a corresponding amount so that the image is properly placed on the substrate. A translating roll device 30, which includes a drive roll 35 and an idler roll 37 which cooperate to form a drive nip and a mechanism 31 to move the drive nip transverse to the paper path direction in response to a signal from the machine controller can be utilized to align the substrate with the image on the photoreceptor. As described in the previously referenced U.S. patent application Ser. No. 07/891,106 now U.S. Pat. No. 5,219,159, a sensor 33 may be positioned to detect when the edge of a sheet passes a certain lateral position. If a stepper motor is utilized to translate the drive nip, the sheet can be accurately positioned a predetermined number of steps to one side or another of the sensor, corresponding to the position of the image on the photoreceptor. Utilizing such an arrangement can allow the position of the images and the substrate to be varied over an area in increments as small as one step of the stepper motor.

As shown in FIG. 1B it is also possible to use a hard registration edge 39 that is positionable in a plurality of lateral locations and to correspondingly vary the image position and the hard registration edge position to maintain proper image alignment on the substrate.

It can be seen that as a result of the offsetting of the imaging data $I_1$ and $I_2$, between sheets or between job runs of a particular job performed on the printing machine, and corresponding offsetting the position of the substrate, the position of high concentration of pressure on the fuser roll 48 and backup roll 50 is spread across a wider area. This minimizes the previously discussed stress line and excessive wear on concentrated portions of the fuser roll as discussed previously. This offset of sheets passing through the fuser also prevents a high concentration of release agents such as silicone oil to build up in one specific location which can later result in either oil on sheets when a larger legal size sheet is used or can even result in sheet jams due to slippage caused by the excess oil buildup.

The preferred embodiment herein has been demonstrated utilizing a digital printing machine. The same effect could also be accomplished utilizing a light lens copying machine and varying the position of the original as placed on the platen. This could be accomplished by means of an automatic offsetting device within a document handler or simply by manually offsetting the placement of various sheets on the platen prior to copying and causing the machine registration edge in the transfer zone to be adjusted accordingly. Likewise, the offsetting of sheet registration can be accomplished by the use of a virtual registration edge as discussed previously or by simply having a moving edge registration guide which is adjusted in accordance with the varying position of the image data on the photoreceptor belt. Other methods to vary the image location on the photoreceptor and correspondingly varying the substrate registration with the image data are possible and are within the spirit of the disclosed invention herein.

It should be noted that in some printing machines, it may be possible to allow the image data and sheet registration position to remain fixed and to simply vary the location of the sheet between the transfer station and the fusing station. However, in most modern printing machines, the paper path between the transfer station and fusing station is not long enough to allow the sheet to be adjusted laterally without smearing the image as the lead edge of the sheet often enters the fusing station before the trail edge of the sheet has completely cleared the transfer station.

In recapitulation, there is provided a system to extend fuser roll life in which image data is varied in its placement on the photoreceptor member and correspondingly, the image receiving substrate position is varied so as to maintain proper location of the image data on the substrate. This position varying may take place sheet to sheet or in a job by job arrangement on a printing machine. This varying of lateral position of the sheet causes the high pressure, excessive wear area on the fuser roll to be distributed over a wider area on the roll and not concentrated at a single point at each edge of the sheet. This leads to longer fuser roll life and additionally provides the added benefit of preventing an oil buildup which degrades copies when larger legal size sheets are utilized and/or also preventing associated jams due to the oil buildup at the sheet edge.

It is, therefore, apparent that there has been provided in accordance with the present invention, a system to extend fuser roll life that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for fixing images to a substrate moving along a path, comprising:
   a fuser roll;
   a pressure member in contact with the fuser roll to form a nip therebetween; and
   means for varying the substrate position in a direction transverse to the path, prior to the substrate entering the nip, so that successive substrates move through the nip in a different position.

2. An apparatus for fixing images to a substrate moving along a path, comprising:
   a fuser roll;
   a pressure member in contact with the fuser roll to form a nip therebetween; and
   means for varying the substrate position in a direction transverse to the path so that successive substrates move through the nip in a different position, wherein said varying means comprises a controller adapted to receive a signal and generate a position signal responsive thereto; a substrate edge sensor adapted to detect an edge of the substrate and transmit a signal indicative thereof to said controller; and means for translating the substrate transverse to the path in response to the position signal from said controller.

3. An apparatus according to claim 2, wherein the translating means comprises:
   a drive roll; and
   an idler roll in contact with said drive roll so as to form a nip therebetween.

4. An apparatus according to claim 3, wherein the pressure member comprises a roll.

5. An apparatus for fixing images to a substrate moving along a path, comprising:
   a fuser roll;
   a pressure member in contact with the fuser roll to form a nip therebetween; and
   means for varying the substrate position in a direction transverse to the path so that successive substrates move through the nip in a different position, wherein said varying means comprises a controller adapted to receive a signal and generate a position signal responsive thereto and a laterally movable substrate registration guide operatively associated with said controller so as to be responsive to a signal from said controller so that successive sheets of the substrate are positioned in varying positions transverse to the direction of paper travel along the path.

6. An apparatus according to claim 5, wherein the pressure member comprises a roll.

7. An electrophotographic printing machine of the type having an image recorded on a photoconductive member moving in a process direction, a developer unit for developing the image, a transfer unit for transferring the developed image to a substrate moving along a path, and a fusing unit including a fuser roll in contact with a pressure member to form a nip therebetween through which the substrate with the developed image thereon passes during fixing of the developed image to the substrate, wherein the improvement comprises:
   means for varying the image position recorded on the photoconductive member in a direction transverse to the process direction; and
   means, responsive to said varying means, for adjusting the substrate position in a direction transverse to the path so that the transfer unit transfers the developed image to a selected position on the substrate with successive substrates moving through the nip formed by the fuser roll and pressure member in a different position transverse to the path.

8. A printing machine according to claim 7, wherein the adjusting means comprises:
   a controller adapted to receive a signal and generate a position signal responsive thereto based on the recorded image location;
   a substrate edge sensor adapted to detect an edge of the substrate and transmit a signal indicative thereof to said controller; and
   means for translating the substrate transverse to the path in response to the position signal from said controller so as to position the substrate to receive the developed image from the photoconductive member.

9. A printing machine according to claim 8, wherein the translating means comprises:

a drive roll; and an idler roll in contact with said drive roll so as to form a nip therebetween.

10. A printing machine according to claim 7, wherein the adjusting means comprises:

a controller adapted to generate a position signal based on the recorded image location; and a laterally moveable registration guide operatively associated with said controller so as to position the substrate to receive the developed image from the photoconductive member.

11. A method of electrophotographic printing in which an image recorded on a photoconductive member moving in a process direction is developed and transferred to a substrate moving along a path, the substrate with the transferred image moves through a nip defined by a fuser roll and a pressure member fusing the image to the substrate, comprising the steps of:

varying successive image positions recorded on the photoconductive member in a direction transverse to the process direction; and adjusting the substrate position in a direction transverse to the path in response to said varying step to transfer the developed image from the photoconductive member to the substrate in a selected position which successive substrates moving through the nip in positions transverse to the path.

12. The method of claim 11, wherein the adjusting step comprises:

receiving a signal and generating a position signal responsive thereto based on the recorded image location;

detecting an edge of the substrate and transmiting a signal indicative thereof; and translating the substrate transverse to the path in response to the position signal to position the substrate to receive the developed image from the photoconductive member.

* * * * *